US009000926B2

(12) United States Patent
Hollock et al.

(10) Patent No.: US 9,000,926 B2
(45) Date of Patent: Apr. 7, 2015

(54) MONITORING HAND HYGIENE

(76) Inventors: Stephen Hollock, Gloucestershire (GB); Neil Johnson, Northampton (GB); Nicola Cross, Northampton (GB)

( * ) Notice: Subject to any disclaimer, the term of this patent is extended or adjusted under 35 U.S.C. 154(b) by 278 days.

(21) Appl. No.: 13/118,127

(22) Filed: May 27, 2011

(65) Prior Publication Data

US 2011/0291841 A1 Dec. 1, 2011

(30) Foreign Application Priority Data

May 27, 2010 (GB) ..... 1008830

(51) Int. Cl.
*G08B 23/00* (2006.01)
*G08B 21/24* (2006.01)

(52) U.S. Cl.
CPC ..... *G08B 21/245* (2013.01)

(58) Field of Classification Search
CPC ..... G08B 21/22
USPC ..... 340/573.1, 574.3, 539.13, 521; 250/338.3; 382/103
See application file for complete search history.

(56) References Cited

U.S. PATENT DOCUMENTS

| | | | | |
|---|---|---|---|---|
| 4,799,243 | A * | 1/1989 | Zepke | 377/6 |
| 4,926,051 | A * | 5/1990 | Turnbull | 250/332 |
| 6,727,818 | B1 | 4/2004 | Wildman et al. | |
| 7,408,470 | B2 | 8/2008 | Wildman et al. | |
| 7,551,092 | B1 | 6/2009 | Henry | |
| 2006/0132316 | A1 * | 6/2006 | Wildman et al. | 340/573.1 |
| 2008/0074252 | A1 * | 3/2008 | Micko | 340/521 |
| 2008/0246599 | A1 | 10/2008 | Hufton et al. | |
| 2008/0285802 | A1 * | 11/2008 | Bramblet et al. | 382/103 |
| 2009/0014654 | A1 * | 1/2009 | Zhevelev et al. | 250/339.02 |
| 2009/0087028 | A1 * | 4/2009 | Lacey et al. | 382/103 |
| 2009/0091458 | A1 * | 4/2009 | Deutsch | 340/573.1 |
| 2009/0119142 | A1 * | 5/2009 | Yenni et al. | 705/7 |
| 2009/0267776 | A1 | 10/2009 | Glenn et al. | |
| 2009/0301523 | A1 * | 12/2009 | Barnhill et al. | 134/18 |
| 2009/0302220 | A1 * | 12/2009 | Micko | 250/338.3 |
| 2010/0117823 | A1 * | 5/2010 | Wholtjen | 340/539.13 |
| 2010/0117836 | A1 * | 5/2010 | Seyed Momen et al. | 340/573.1 |

FOREIGN PATENT DOCUMENTS

| | | | |
|---|---|---|---|
| EP | 1872802 | A1 | 1/2008 |
| WO | WO-01/33529 | A1 | 5/2001 |
| WO | WO-02/059701 | A1 | 8/2002 |

(Continued)

OTHER PUBLICATIONS

European Patent Office, Extended European Search Report dated Nov. 9, 2011 for the application No. EP11167728.2.

(Continued)

*Primary Examiner* — Hai Phan
*Assistant Examiner* — Zhen Y Wu
(74) *Attorney, Agent, or Firm* — Gable Gotwals

(57) ABSTRACT

A method of monitoring hand washing by individuals comprises monitoring the movements of individuals in an area using one or more sensors, identifying the performance of an act by an individual that requires the hands of the individual to be washed and determining whether the hands of the individual are washed after the performance of the act, wherein the determining includes tracking the motion of that individual using the one or more sensors. Sensors comprising arrays of thermal detectors are preferred, but other types of sensor could be included.

16 Claims, 7 Drawing Sheets

(56) References Cited

FOREIGN PATENT DOCUMENTS

| | | | |
|---|---|---|---|
| WO | WO-2007/090470 | A1 | 8/2007 |
| WO | WO-2007/127495 | A2 | 11/2007 |
| WO | WO-2009/097096 | A1 | 8/2009 |
| WO | WO-2010/151802 | A2 | 12/2010 |

OTHER PUBLICATIONS

Intellectual Property Office, Combined Search and Examination Report dated Jul. 9, 2010 for the application No. GB1008830.0.

* cited by examiner

MONITORING HAND HYGIENE

BACKGROUND

1. Field

The present invention relates to the monitoring of hand hygiene.

2. Background

There are numerous situations where hand washing or otherwise cleansing is particularly important, such as in hospitals, food preparation areas and public toilets. Statistics show that people in general do not wash their hands as often as needed for infection control. Therefore it would be useful to be able to monitor the observance of hand washing requirements. However in the situations where this is likely to be most useful personal privacy is particularly important. Therefore it is preferable that any monitoring should be done in a non-intrusive way.

The frequency of hand washing or cleansing by groups of people can be estimated from the amounts of soap used. This data does not correlate activities that require the hands to be washed with the amount of soap used.

SUMMARY

In one aspect there is provided in the following a method of monitoring hand washing by individuals comprising; monitoring the movements of individuals in an area using at least one sensor, identifying the performance of an act by one of the individuals that requires the hands of the individual to be washed before and/or after the performance of the act and determining whether the hands of an individual are washed;

wherein the sensor comprises a two dimensional array of thermal detectors and the method comprises processing signals from the detectors to perform one or more of a group of actions comprising:

tracking the motion of individuals, providing an indication that an individual has performed an act that requires hand washing, and providing an indication that an individual has performed a hand wash.

It should be noted that "washing" is not limited to the use of water and encompasses the application of water or some other liquid for the purpose of cleansing. Thus "washing" includes but is not limited to the use of sanitising wipes, conventional washing with soap and water and the application of other cleansing liquids such as gel rubs.

It should also be noted that "an act that requires hand washing" might in practice comprise a series of two or more actions such as entering a zone such as a zone around a hospital bed and spending a minimum amount of time at an area of interest, e.g. an area within the zone such as an area next to a piece of equipment. In other words some implementations might require two or more actions to take place before it is determined that an act that requires hand washing has taken place.

By tracking the movement of an individual it is possible to determine whether the same individual that performed an act requiring hand washing is the one that performs a hand wash operation. This is an improvement over a system that simply counts the number of "hand wash required" acts and the number of instances of hand washing. The sensor may also be used to provide an indication that an individual has performed an act that requires hand washing, and/or provide an indication that an individual has performed a hand wash.

In another possible implementation the sensor may be used to track the movements of the individual and one or more ancillary devices may be used to provide the aforementioned indications. These might include touch sensors, sensors on dispensers of cleansers and other ancillary devices.

Instead of tracking the movements of individuals from place to place, one or more sensors each comprising a two dimensional array of thermal detectors may be used for identifying the performance of an act that requires the hands of an individual to be washed and/or determining whether the hands of an individual are washed. For example if a subject dwells at a particular location this might indicate that a certain act has been performed.

It is likely that a system implementing the method will need to be "trained" for the environment in which it is to operate. The compilation of statistical data in a manner to be described in more detail below can be used to determine the probability that a particular act has been performed. With more data accumulated over time it is possible to have more confidence that an act has been performed, i.e. the probability values will be higher. Thus by training the system its efficacy to detect events such as washing hands, touching a patient etc will improve.

In the simplest case the method is used simply to count the number of "hand wash required" events and the number of instances of hand washing. These can then be compared to provide an indication as to whether hand wash rules are complied with. However it is possible to track particular individuals to determine whether an individual that has performed a "hand wash required" operation washes their hands prior to or subsequent to the "hand wash required" event.

For reasons to be explained below it is preferred that any sensor used to monitor the movements of the individuals should provide very low resolution by comparison to a known CCTV camera. The number of detector elements in each sensor is preferably no more than 10,000. In some possible embodiments the number of elements is no more than 2000.

On the other hand there should be sufficient elements to be able to track movement rather than simply detect the presence or absence of an individual, as is possible with a simple PIR detector. This can be achieved with as few as 50 elements. Thus in some applications of the method the sensor has at least 50 elements. A higher number such as 200 may be preferred for certain applications. Since the array will usually but not necessarily be square, in one embodiment the array preferably comprises at least 16×16 detector elements. It will be appreciated that the array may be rectangular, circular or any suitable shape.

Closed circuit television cameras (CCTV) have been used in video surveillance but are often deemed unacceptable because of intrusiveness. In other words, they provide such detailed information that they are not thought to be acceptable to persons whose behaviour might need to be monitored. Possibly "fuzziness" could be created to degrade a sharper image in a CCTV image. However, it is now known that such "artificial" blurring of an original clear image is capable in certain circumstances of being reversed by sophisticated digital means. Therefore for reasons of privacy for the individual it is preferred that the source of the data to be processed is very low in resolution. Thus information is not stored in the first place and could not therefore be digitally extracted later. Thermal sensors are ideal for this purpose and have other advantages. The preferred thermal sensor is made up of a two dimensional array of infrared sensitive detector elements, preferably pyroelectric detectors, with the number of elements in the array typically between 16×16 and 33×33, together with an optical lens which focuses an image of the scene onto the detector array. The sensor has readout means for monitoring signals from the detectors and means for interpreting such signals to determine the presence of selected targets and tracking their motion in time and space. The sensor has analysis means to further characterise this information as required for the invention described elsewhere. The preferred sensor is not chopped or shuttered to provide a comparison between a blank scene and the active scene to facilitate image difference processing (described elsewhere) but such a facility might be included in certain circumstances to assist in identification of, for example, stationary objects. A suitable sensor is described in EP-A-0853237.

The preferred thermal sensors comprise arrays of thermal detector elements, e.g. pyroelectric detector elements, which produce images that are blurred (fuzzy) in space. This is due in part to the low resolution of the arrays and to the use of low-cost optics which have limited acuity, but also to the fact that each detector element shows only changes in the images. In addition, due to the nature of the material that receives the infra-red signal, the thermal signal 'bleeds' or diffuses laterally through the material of the infrared detector array, so adding to the blurring. In this way, the anonymity and privacy of the individual are maintained.

As will be described in more detail below, using the preferred sensor, the nature of the thermal image obtained from a person moving around in the field of view of a detector is such that there is no possibility of obtaining detail regarding what an individual looks like or is doing except in the most basic way. For compliance enforcement an additional identification of the individual might be added such as an RFID tag. However these too are considered in some circles to be too intrusive and some groups of individuals are resisting requirements to use identification devices.

Another advantage of thermal imagers over CCTV is that thermal detectors are able to work under varying light conditions including conditions that would make the use of CCTV extremely difficult. Working in the infra-red allows this system and method to work easily under any normal indoor lighting conditions, including complete darkness.

Another advantage is that a pyroelectric detector sees only changes in its field of view, so background clutter 'disappears', allowing the system to focus on the objects of interest. This coupled with the fact that a low resolution sensor is preferred leads to a great saving in terms of data to be processed.

In a preferred embodiment of the invention, one or more sensors each comprising a two dimensional array of thermal detectors is/are used to identify the performance of an act that requires the hands of the individual to be washed. In some applications, such as hand washing after toilet use in which the wash basin is in the same enclosure as the toilet, entry of the individual into the enclosure might be deemed to be an act that requires the hands of the individual to be washed. In that case a door opening sensor might be used to identify the entry of the individual into the enclosure. With the use of sensors to track the motion of the individual it will be possible to discriminate between the door being opened and no-one entering the enclosure and the door being opened and a person entering the enclosure.

It is also preferable for the one or more sensors to be used to determine whether the hands of the individual are washed after the performance of the act. This could be done by, for example, simply determining that the individual has spent a minimum amount of time at a hand washing station. It will be appreciated that this is not an accurate determination since this does not confirm that the individual's hands have actually been washed. However it may provide a fair approximation.

It is possible to provide a sensor on a soap dispenser to give an indication of an instance of hand washing. Data from such a sensor could be used instead of or in addition to signals from the one or more sensors mentioned above to determine whether the hands of the user have been washed.

The method is particularly useful for obtaining data relating to compliance with hygiene regulations. Therefore it is useful to increment a counter for each identification of the performance of an act by an individual that requires the hands of the individual to be washed, and to increment a counter for each determination that an individual having performed an act that requires the hands to be washed then performs a hand washing operation. This then gives an indication of the percentage compliance with the regulations. Instead of incrementing a counter for each identification of the performance of an act by an individual that requires the hands of the individual to be washed the same statistics could be prepared from a count of the number of instances of such an act that are not followed by hand washing by the individual.

Thus a preferred embodiment of the invention comprises incrementing a compliance counter for each determination that an individual having performed an act that requires the hands to be washed is preceded or followed by a hand washing operation according to requirements associated with the act. In other words, for a "pre-wash required" event the compliance counter is incremented if hands are washed before the event and for a "post-wash required" event the compliance counter is incremented if hands are washed after the event. Otherwise a non-compliance counter may be incremented. For events that require both pre and post wash, a compliance counter can be incremented only if hands are washed before and after an event.

For some applications there are multiple different acts that require the hands of an individual to be washed and these can be separately identified. An example is the area around a hospital bed. World Health Organisation guidelines identify "5 Moments for Hand Hygiene" as:

1) before touching a patient (e.g. on entry into the bed area)
2) before any clean/antiseptic procedure
3) after body fluid exposure risk
4) after touching the patient
5) after touching the patient surroundings.

Some or all of these can be identified using the kinds of sensor described above.

The area under observation may include multiple hand washing stations and hand washing operations at the respective hand washing stations may be separately determined in order to provide more detailed information relating to compliance with regulations.

The processing of signals from the detectors may comprise compiling statistical data over time indicating the frequency of one or more subject behaviours in relation to multiple regions or points in the space. For a more detailed explanation of the compilation of data in this way attention is directed to European patent application 10196951.7. The multiple points or regions in the space are preferably adjacent to each other and preferably combine to cover the whole of the space. It is then possible to generate an "activity map" relating to an area being monitored. This may be used in the determination of the probability that any of the events described above has taken place. An example of an activity map is shown below by way of further indicating the non-intrusiveness of the monitoring by the sensor(s).

Several "activity maps" might be generated. For example typical behaviour may vary depending on the time of day. Thus the method might use multiple compilations of statistical data over different time periods in terms of length or time of day, each indicating the frequency of one or more subject behaviours in relation to multiple regions or points in a space.

There is also provided in what follows a system for monitoring hand washing by individuals configured to perform the steps of the method described above comprising one or more sensors, and one or more processors for processing signals from the sensors.

There is also provided a computer readable medium comprising instructions that when executed by a processor in a system comprising one or more sensors cause the system to execute the steps of the method described above.

DETAILED DESCRIPTION

As noted above, it is preferred not to use high resolution imaging sensors. The reason for this will firstly be explained in more detail with reference to FIGS. 1 to 4.

Figure 1:
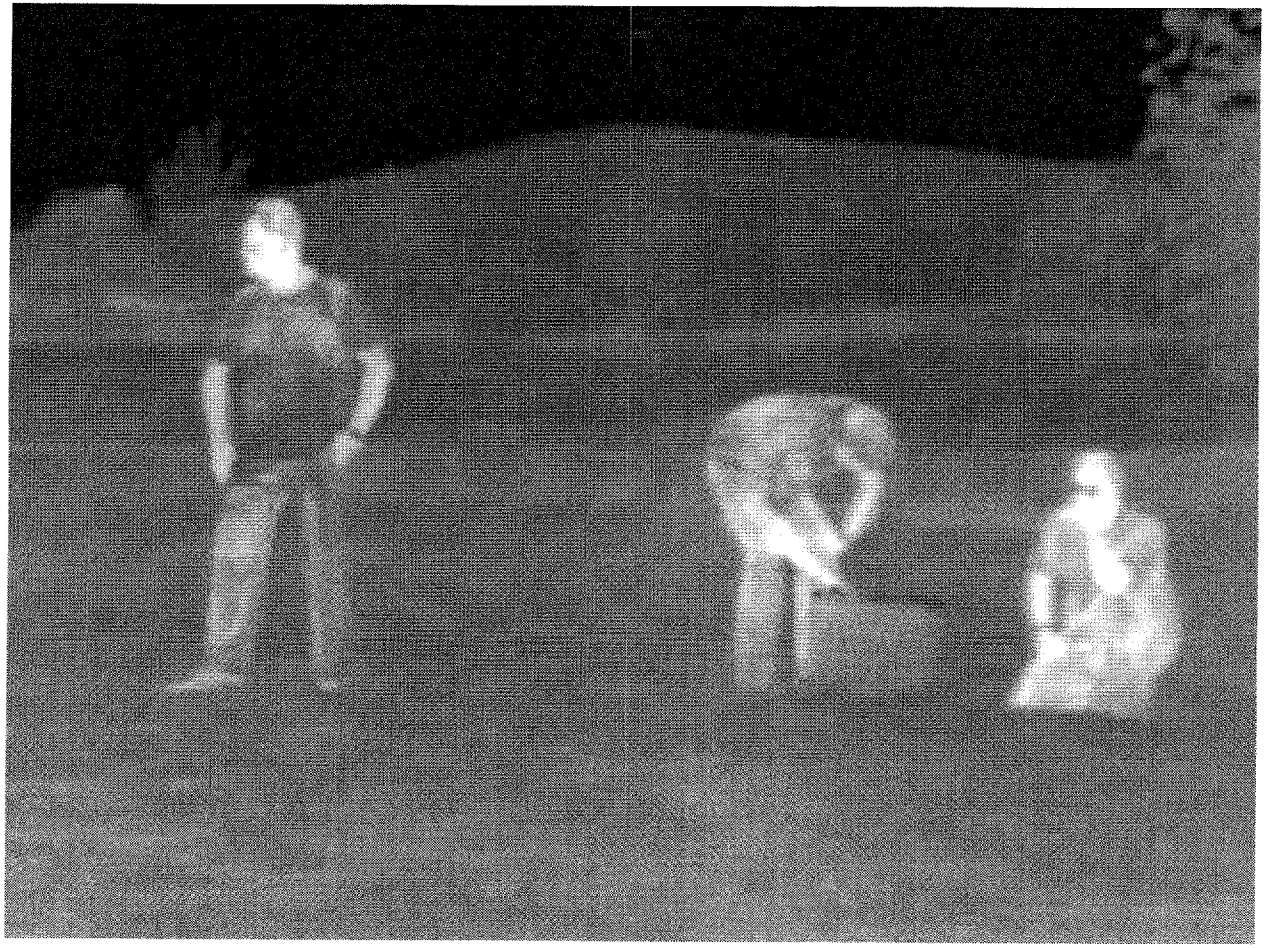
FIG. 1 shows, for the purpose of comparison, a comparatively high resolution image from a high resolution thermal imaging camera.

High quality thermal imagers produce movie-like images which will record the thermal scene in detail and in particular will "see" stationary targets in the field of view as well as moving objects. This combined with a higher resolution (pixels per unit field of view) makes facial identification possible, and could display detailed behaviour (scratching, nose picking etc). An example image from a high resolution thermal imager is shown in FIG. 1. The sensor used to produce this image would typically have over 76,000 detector elements.

The system and method of the invention preferably use low element count thermal detector arrays which show insufficient detail to be intrusive. The arrays could use pyroelectric detectors or resistive bolometers for example.

Pyroelectric detectors produce a signal or image only when the incident infrared radiation is modulated, either by movement of the target or by means of a mechanical chopper. If a pyroelectric array "stares" through a suitable lens at a stationary scene, no image will be produced. In order to produce an image a mechanical chopper must be used with image difference processing to subtract the chopper-closed signal from the chopper-open signal.

Figure 2:
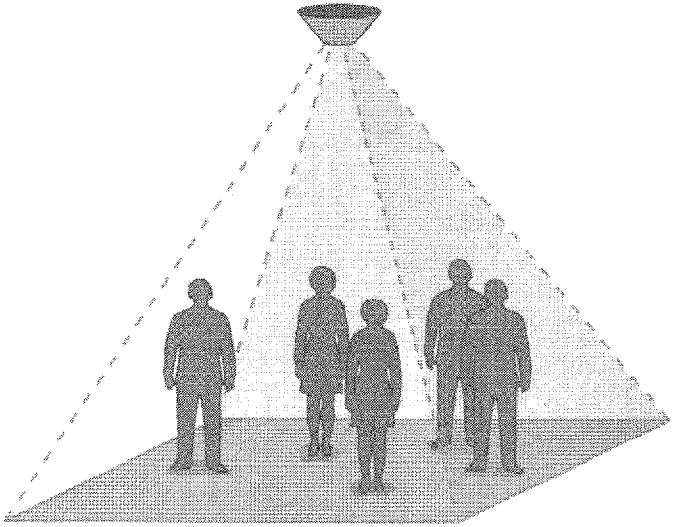
FIG. 2 is a schematic diagram showing a ceiling mounted sensor comprising an array of thermal detector elements with its associated field of view.
Figure 4:
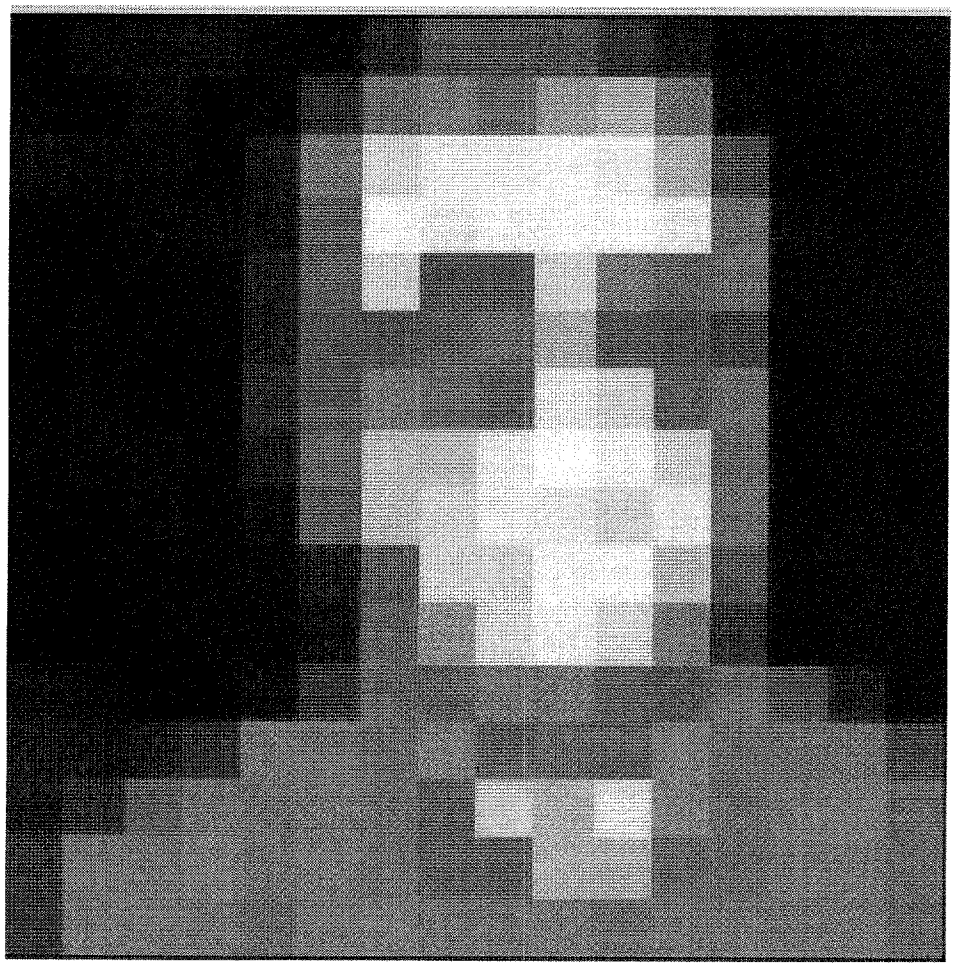
FIG. 4 shows a "chopped" image of a face using a 16×16 thermal imager with image difference processing.

The system and method of the invention can be implemented using low element count pyroelectric arrays without a chopper or image difference processing. As noted above pyroelectric detectors only respond to changes in the input radiation, so a moving target becomes a "blurred blob" in an otherwise uniform image. This "blob" can be tracked and identified as a target but only gross actions (walking, stopping, rapid speed changes etc) of the target can be seen. If the target remains motionless it disappears from the image altogether and it is by using a tracking algorithm that knowledge of the target's location can be retained and it can be picked up again when it moves. FIG. 2 shows a ceiling-mounted 16×16 sensor viewing five people moving through the field of view and FIG. 3 shows an un-chopped image obtained from the sensor to illustrate how little resolution is needed in order to implement the method and system of the invention.

Notwithstanding the foregoing, for some applications it may be desirable to incorporate some image difference processing in order to collect limited additional information about fixed objects such as chairs and tables. By chopping the image on a pyroelectric detector it is possible to artificially create a time dependent signal and so stationary heat sources (targets) show up on the image. Even with such image difference processing low spatial resolution of sensors still ensures that the system is not undesirably intrusive.

Figure 3:
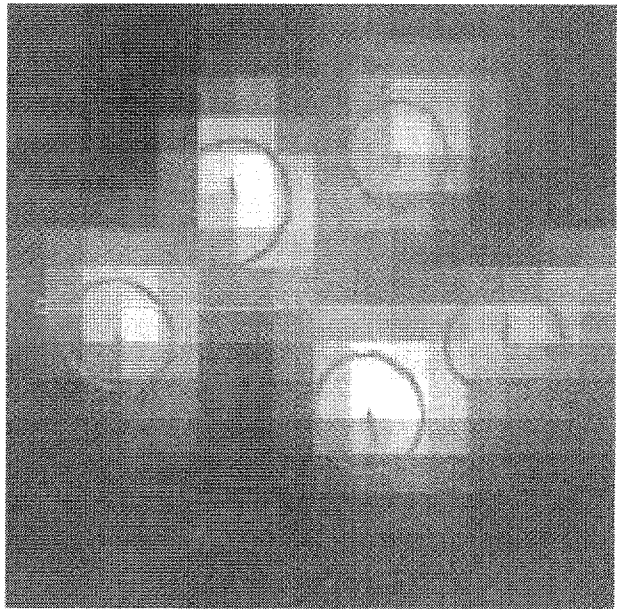
FIG. 3 shows a typical "un-chopped" image produced by a 16×16 array in the arrangement of FIG. 1.

It is clear from FIG. 3 that only 16×16 elements lead to an extremely coarse picture. By comparison the "minimum" spatial resolution for a thermal imager of sufficient quality to "see" objects reasonably clearly is 160×120 and can be 384×288 or better as shown in FIG. 1. Chopped imagers with 16×16 elements still show targets as animated "blobs" as can be inferred from the chopped image shown in FIG. 4. Of course the actual level of detail available from a sensor depends on its field of view and distance between the sensor and the target. Typically imagers have a 20° field of view but can have as narrow as 10° or as wide as 35° or more. The wider the angle the greater the area of scene transferred to the imaging plane and for objects at a similar distance the detail will be lower. However for a wide field of view a target could stand much closer to the sensor to be seen more clearly.

Figure 5:
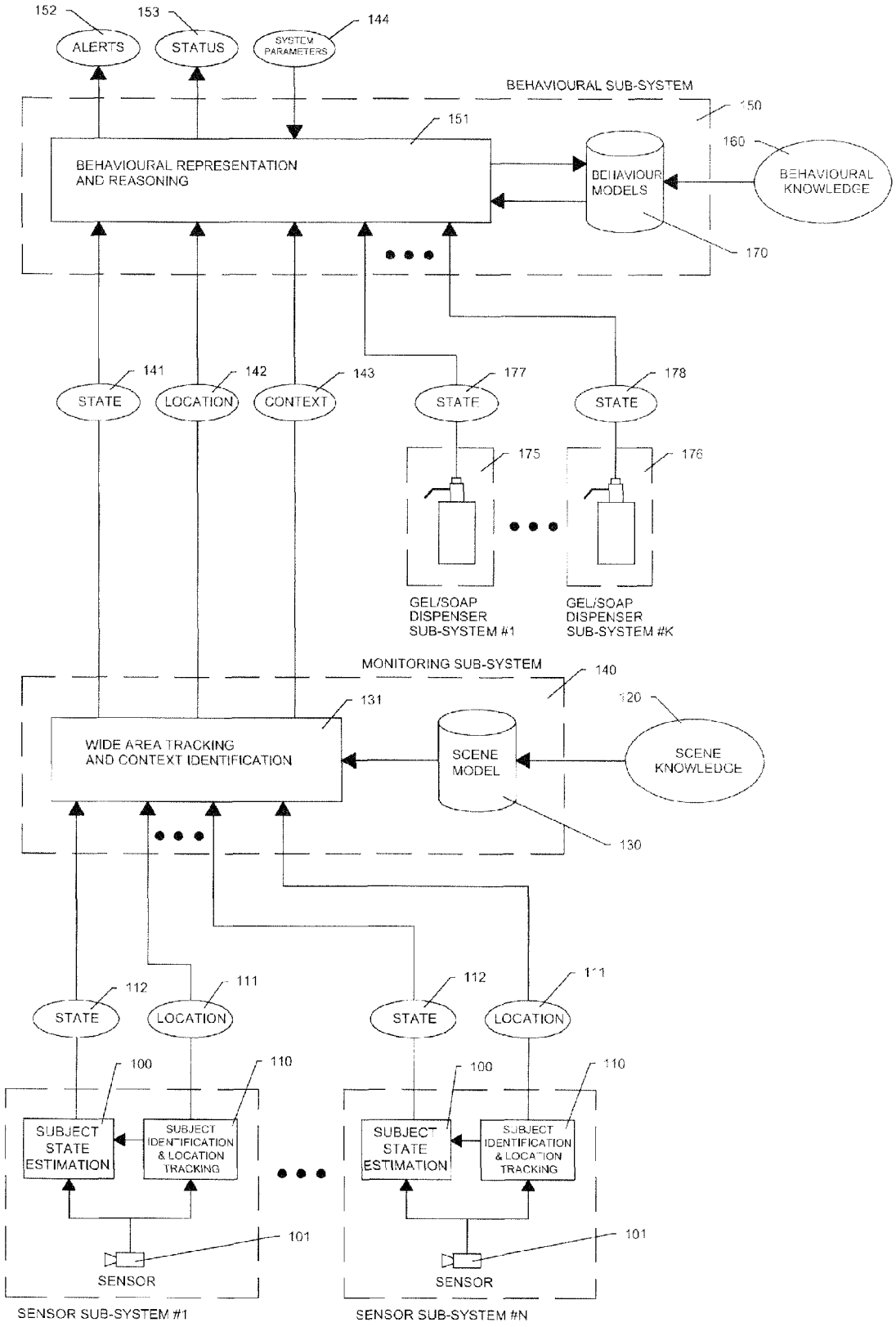
FIG. 5 is a schematic diagram of a system suitable for implementing the method of the invention.

Referring now to FIG. 5, the illustrated system comprises one or more sensor sub-systems #1 . . . #N which provide basic monitoring of individual areas within a monitored space. Each sensor sub-system comprises a sensor 101 comprising an array of thermal detectors together with subject identification, location and tracking system 110 and state estimation system 100. In this context, "identification" means determination that an individual to be tracked exists, rather than identification of one individual among multiple individuals. As shown in the figure, the state estimation system utilises information from the sensor 101 as well as the location and tracking system in order to estimate the state of the subject. Examples of "state" include speed of motion, orientation of body and "shape" of body (e.g. arms outstretched). Each sensor sub-system #1 . . . #N provides rejection of noise and 'false-alarm' signals and outputs estimates of the location 111 and current state 112 of any subject within its field of view.

A monitoring sub-system 140 accepts subject location 111 and state 112 information from the one or more sensor sub-systems #1 . . . #N. Sub-system 140 includes a scene model 130 compiled from a knowledge base 120 (which may be externally provided) of scene layout data. Wide area tracking and context identification processing 131 within sub-system 140 transforms the multiple location and state estimates from sensor sub-systems #1 . . . #N into a more consistent, higher-level, description of the subject's state 141, location 142 within the entire monitored space, also adding contextual information 143 derived from the scene model 130. At this intermediate level, the system is also able to resolve issues associated with the presence of multiple subjects within the monitored area and provide more complex noise and 'false-alarm' rejection.

A behavioural sub-system 150 accepts high-level subject state 141, location 142, and context 143 information as well as system parameters 144 (such as the presence of a pet) and these are input to behavioural representation and reasoning processing 151. The system also includes gel or soap dispenser subsystems 175 and 176 (and possibly more) which output state information 177 and 178 respectively relating to the activation of soap dispensers. The dispensers could have sensors that detect the activation of a push top or they could have level indicators that determine when a measure of soap is dispensed. The subsystems could be more complex and include video cameras checking whether hands are washed properly.

The purpose of behavioural sub-system 150 is to identify events that require hand washing and instances of hand washing. This is done using a database 170 containing models of events that require hand washing and instances of hand washing. Input data to behavioural representation and reasoning processing 151 relating to state, location and context from the dispenser subsystems 175, 176 and from the wide area tracking and context identification processing 131. This is processed and used in conjunction with the models of behaviour in database 170 to identify events. The database may use knowledge supplied from an external source 160 and/or learned behaviour from training the system in situ. The models may be updated from time to time based on current information, hence the two way flow of data between the models 170 and the behavioural representation and reasoning 151.

The various "systems" illustrated in FIG. 5 may be implemented using any suitable apparatus as will be apparent to a person skilled in the art. The state estimation systems 100 and tracking systems 110 may take the form of one or more signal processors housed with the sensors or may be remote from the sensors. The remaining systems 140 and 150 would typically be remote from the sensors themselves and may take the form of one or more suitably programmed computers with associated memory.

Two example methods are now explained with reference to FIGS. 6 and 7.

The processes described with reference to FIGS. 6 and 7 split naturally into 3 parts:

1. Detecting a hand wash requirement
2. Detecting a hand wash event.
3. Compliance processing—storing and displaying the results.

Detecting a Hand Wash Requirement

The process typically begins when an individual is detected entering a predefined space or 'sensitive' zone (e.g. food preparation area, toilet cubicle, patient's bedside). After entry, the individual may or may not be required to wash their hands; this will depend on the nature of the application and on what happens next. For some applications, simple entry to the sensitive zone (e.g. toilet cubicle) defines the wash criteria. In another application, an external input might also be required; for example, a signal from an electronic tag that is worn by certain categories of individuals such as care workers. Other hand wash applications may also require evidence from the scene analysis algorithms that the subject's behaviour indicates an action that is associated with the need for a hand wash.

Detecting a Hand Wash Event

Again the process typically begins with the entry of a individual into a predefined sensitive zone; in this case the zone would usually be of the hand wash type. Hand wash events take a number of forms: simple gel rubs are often used, in some cases a conventional soap and water wash is appropriate. Other variations occur when gloves are donned after washing and/or the individual may carry a personal gel dispenser. Gel and soap dispensers can be instrumented such that a signal is issued when the containers are used. The system can use these signals to help it decide when and where a hand wash event has taken place. The system can also identify a hand wash event from behavioural analysis of the individuals in the scene. For example, a minimum dwell time appropriate for the washing equipment within the hand wash zone (wash hand basins, gel bottles, etc) can be used to estimate the likelihood of a hand wash event having taken place.

Thus, a hand wash event can be detected by:

1. Scene analysis (dwell times etc), or
2. Signals from instrumented dispensers and/or instrumented individuals, or
3. A combination of both (this is likely to give the most robust estimates).

Compliance Processing

Compliance processing can involve one or more of the following:

1. Estimate compliance statistics from the compliance counts.
2. Update database.
3. Generate any alerts required.
4. Generate reports and update displays.

Examples

Figure 6:
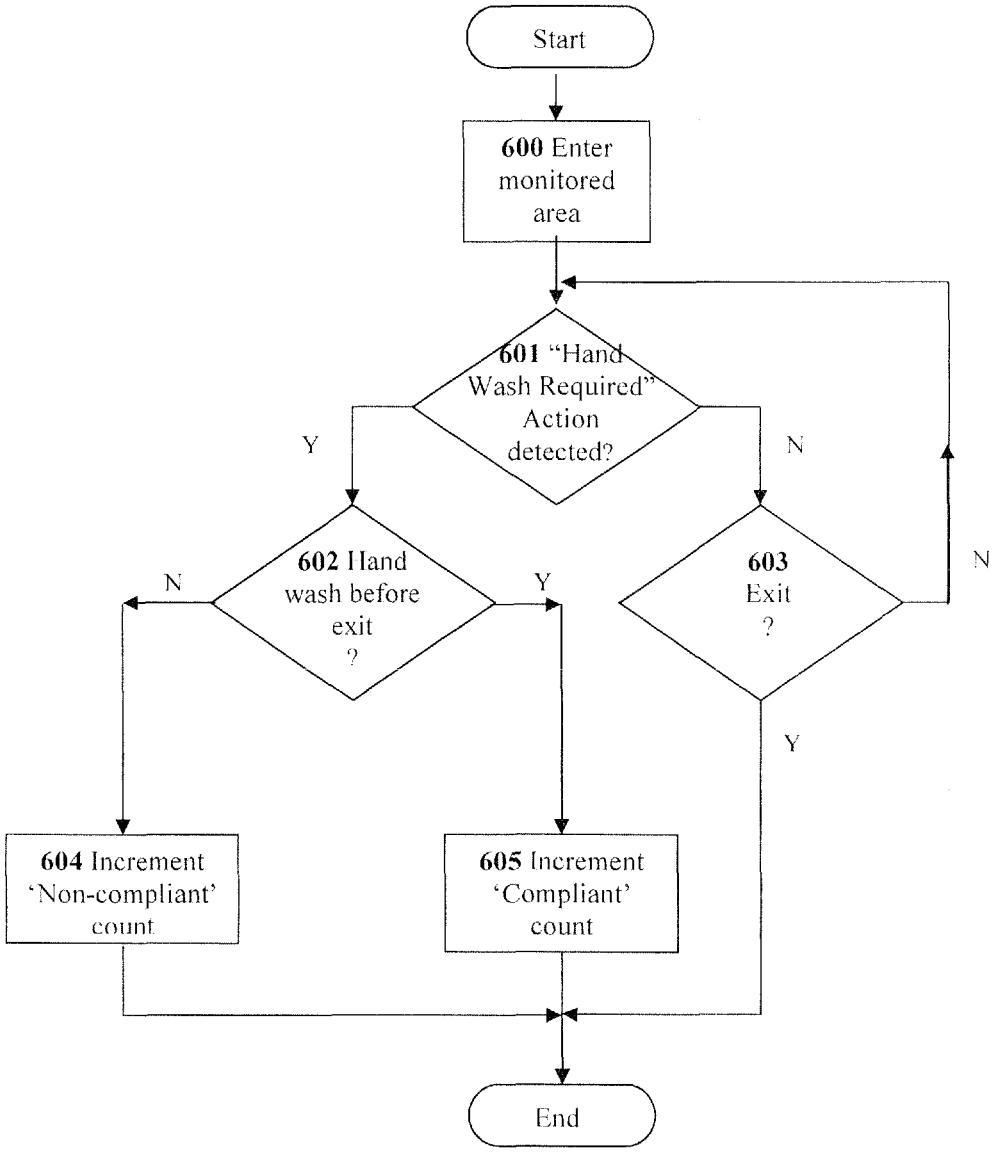
FIGS. 6 and 7 are flowcharts for two possible methods according to the invention.
Figure 7:
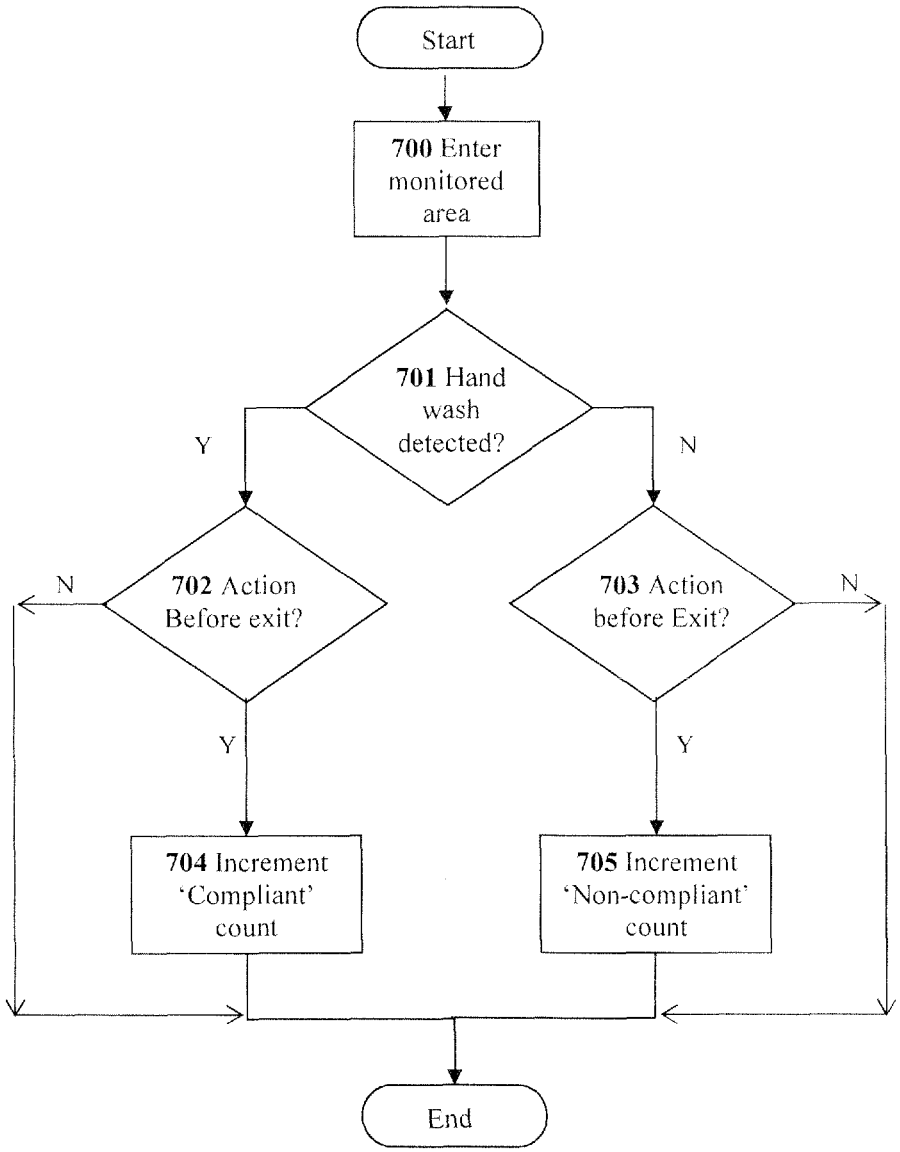

FIGS. 6 and 7 show two examples of the logic that would be required to determine whether an individual has complied with a hand wash requirement that involves both the movement of an individual into a sensitive zone and the performance of some action. The action might consist of a sequence of observed events that suggest that the monitored individual has touched a particular object, for example a piece of medical equipment.

In the flowchart of FIG. 6, the wash criteria are met after an individual has moved into the sensitive zone and has performed some predefined action.

The process starts and at step 600 an individual enters the monitored area. The system now waits at step 601 for an action to occur that has been predefined to require hand washing.

If the monitored individual exits the monitored area before step 601 is satisfied (as tested at step 603) then the process terminates. Otherwise, the logic follows the 'no' branch from step 603, and the system continues to wait for the action to occur at step 601.

If at step 601, the looked-for action is detected then the wash criteria have been met and at step 602 the system begins to look for exit events and hand wash events. If an exit is seen and no hand wash has been observed, then the individual has failed to comply with the wash requirements and a counter is incremented to reflect this. If, on the other hand, a hand wash event is observed before the exit, then the correct sequence of events has occurred and a 'compliance' counter is incremented.

The process terminates on exit of the individual from the monitored area.

In the flowchart of FIG. 7, the hand wash event must precede a predefined action, so the compliance check is made retrospectively.

The process starts and at step 700 an individual enters the monitored area. The system now waits at step 701 for a hand wash event to occur.

If no hand wash event occurs at step 701 and the individual exits the monitored area without performing any action that requires hand washing, this will be detected at step 703 (the 'no' branch is taken) and the process terminates. In this case, the individual has not performed the "hand wash required" action, and so is not required to wash. If on the other hand, the individual exits at step 703 and they have performed the "hand wash required" action (so taking the 'yes' branch), then they have failed to wash before the action so a count is incremented to record the transgression.

Look back now at step 701 and examine the case where a hand wash has been detected. If an exit is detected at step 702 but was not preceded by an action (so leaving 702 on the 'no' branch) then the hand wash event was not required and so it is disregarded and the process is terminated. Contrariwise, an exit from step 702 on the 'yes' branch would be taken if the sequence 'hand wash' then 'action' then 'exit' is detected'. In this case, the individual has been seen to have complied with the hand wash requirement of the action so a 'compliance' count is incremented to record this.

The process terminates on exit of the individual from the monitored area.

It will be appreciated that the methods illustrated in FIGS. 6 and 7 can be combined to determine compliance with rules that require hands to be washed before and after a particular event.

Figure 8:
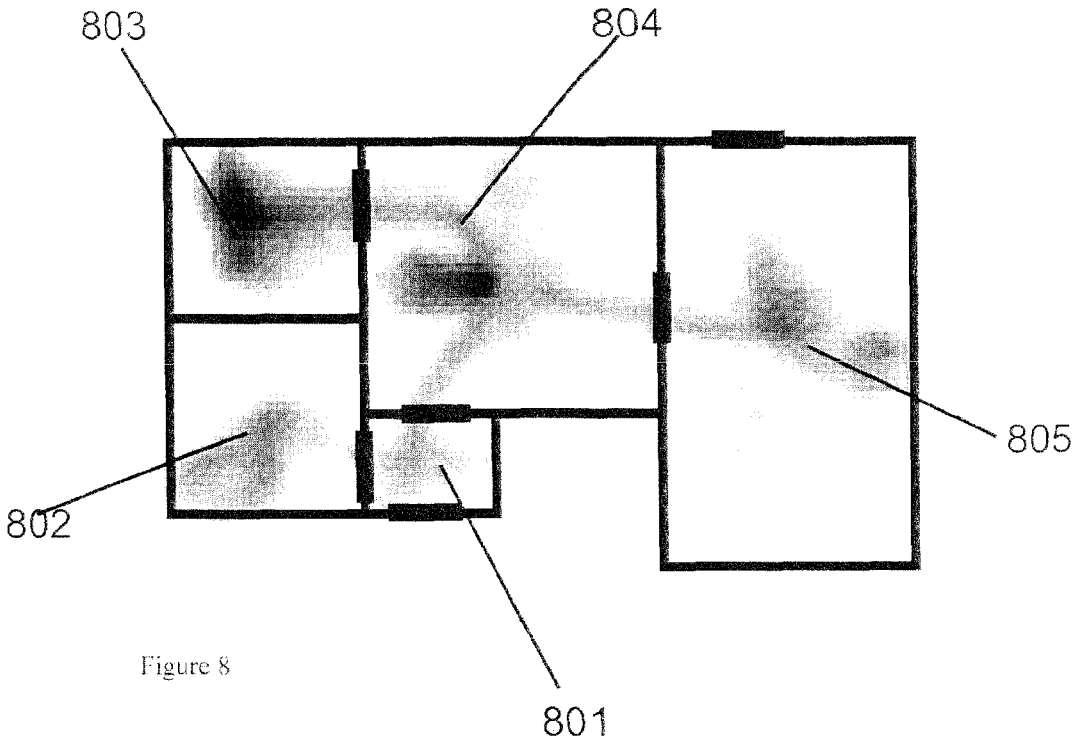
FIG. 8 is an example of an activity map obtained from a sensor to illustrate the non-intrusiveness of the sensors.

FIG. 8 shows the sort of information that might be available from the sensors. FIG. 8 has been obtained by compiling statistical data over time relating to the frequency of areas in several rooms in a domestic setting being occupied. The rectangles in FIG. 8 form a plan view of the area under surveillance comprising a hall 801, bathroom 802, kitchen 803, living room 804 and bedroom 805. In this example a sensor is used to monitor each room. Although not necessarily applicable to hand washing, FIG. 8 illustrates the kind of information that will be available from the sensors. Each small square visible in FIG. 8 relates to a square on the ground (e.g. 1 meter×1 meter) of the space being monitored. The information is in greyscale with the blackest areas being those most frequently occupied. Thus it can be seen that the two most frequently occupied areas for the period over which the data of FIG. 8 was accumulated are in the living room 804, possibly the position of an arm chair, and the kitchen 803, possibly at the sink.

A similar "activity map" to that shown in FIG. 8 can be generated for any area in which the movements of subjects are monitored, such as the area within a toilet cubicle, a kitchen (e.g. in a catering establishment) or the area around a hospital bed. This is useful for the purpose of building up a picture or model of typical behaviour of subjects in the area which can be used to determine with better accuracy that certain acts have been performed. It is possible to use data such as that shown in FIG. 8 to determine the probability that certain parts of the area are occupied at certain times for example. So if for example an activity map indicates that a person regularly enters an area first thing in the morning and then always goes straight to the bedside to take a pulse for example, then any future such action could be confidently identified as a contact requiring a hand wash without additional corroboration that might otherwise be considered necessary. In this way the activity map and its comparison under different conditions (day, night, mealtimes etc) might be used to build up the information from a particular environment which might then be used to interpret future situations "in real time".

It will also be apparent that by detecting only movements of the subject in the space, rather than generating images of the space, the data obtained is limited. For example facial features of the subject cannot be discerned. The presence of the sensors of this type is more acceptable to subjects being monitored as a result of this.

The apparatus described above may be implemented at least in part in software. Those skilled in the art will appreciate that the apparatus described above may be implemented at least in part using general purpose computer equipment or using bespoke equipment.

The hardware elements, operating systems and programming languages of such computers are conventional in nature, and it is presumed that those skilled in the art are adequately familiar therewith. Of course, any server functions may be implemented in a distributed fashion on a number of similar platforms, to distribute the processing load.

Here, aspects of the methods and apparatuses described herein can be executed on a mobile station and on a computing device such as a server. Program aspects of the technology can be thought of as "products" or "articles of manufacture" typically in the form of executable code and/or associated data that is carried on or embodied in a type of machine readable medium. "Storage" type media include any or all of the memory of the mobile stations, computers, processors or the like, or associated modules thereof, such as various semiconductor memories, tape drives, disk drives, and the like, which may provide storage at any time for the software programming. All or portions of the software may at times be communicated through the Internet or various other telecommunications networks. Such communications, for example, may enable loading of the software from one computer or processor into another computer or processor. Thus, another type of media that may bear the software elements includes optical, electrical and electromagnetic waves, such as used across physical interfaces between local devices, through wired and optical landline networks and over various airlinks. The physical elements that carry such waves, such as wired or wireless links, optical links or the like, also may be considered as media bearing the software. As used herein, unless restricted to tangible non-transitory "storage" media, terms such as computer or machine "readable medium" refer to any medium that participates in providing instructions to a processor for execution.

Hence, a machine readable medium may take many forms, including but not limited to, a tangible storage carrier, a carrier wave medium or physical transaction medium. Non-volatile storage media include, for example, optical or magnetic disks, such as any of the storage devices in computer(s) or the like, such as may be used to implement the encoder, the decoder, etc. shown in the drawings. Volatile storage media include dynamic memory, such as the main memory of a computer platform. Tangible transmission media include coaxial cables; copper wire and fiber optics, including the wires that comprise the bus within a computer system. Carrier-wave transmission media can take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards, paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

Those skilled in the art will appreciate that while the foregoing has described what are considered to be the best mode and, where appropriate, other modes of performing the invention, the invention should not be limited to specific apparatus configurations or method steps disclosed in this description of the preferred embodiment. It is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings. Those skilled in the art will recognize that the invention has a broad range of applications, and that the embodiments may take a wide range of modifications without departing from the inventive concept as defined in the appended claims.

What is claimed is:

1. A method of monitoring hand washing by individuals, the method comprising:

monitoring movements of individuals in an area using at least one sensor;

identifying a performance of an act by one of the individuals that requires hands of the one of the individuals to be washed before or after the performance of the act; and determining whether the hands of the one of the individuals are washed, wherein the at least one sensor comprises a low resolution two dimensional array of pyroelectric detectors having a sufficient number of elements to track movement of the one of the individuals in the area and communicates with a state estimation system for outputting information comprising estimates of a state of the individuals monitored by the at least one sensor, and wherein the method further comprises processing signals from the pyroelectric detectors and said state estimation system performing a group of actions comprising:

tracking a motion of the one of the individuals using a tracking algorithm which retains in a memory knowledge of a location of an individual when the individual remains motionless and disappears from an image of the at least one sensor such that the location of the individual is picked up when the individual moves again, providing an indication that the one of the individuals has performed an act that requires that hand washing, and providing an indication that the one of the individuals has performed the hand washing.

2. The method as claimed in claim 1, wherein the actions of the one of the individuals that has performed the act requiring the hand washing are tracked to determine whether the hands of a same individuals are washed.

3. The method as claimed in claim 1, wherein one or more of the at least one sensor is sensitive only to movements taking place within a field of view of the one or more of the at least one sensor.

4. The method as claimed in claim 1, wherein each of the two dimensional array of pyroelectric detectors comprises no more than 10,000 detector elements.

5. The method as claimed in claim 1, wherein that at least one sensor uses image difference processing to determine a position of objects in a field of view of the at least one sensor.

6. The method as claimed in claim 1, wherein, if the one of the individuals spends more than a preset minimum amount of time at a hand washing station, the method further comprises determining that the hands of the one of the individuals have been washed.

7. The method as claimed in claim 1, further comprising processing signals from one or more dispensers of cleanser to identify that the hands of the one of the individuals are washed.

8. The method as claimed in claim 1, further comprising incrementing a compliance counter for each determination that the one of the individuals has performed the act that requires the hands to be washed is preceded or followed by a hand washing operation according to requirements associated with the act.

9. The method as claimed in claim 1, further comprising incrementing a non-compliance counter for each determination that one of the individuals has performed the act is not followed by or preceded by a hand washing operation according to the requirements of the act.

10. The method as claimed in claim 1, further comprising separately identifying multiple different acts that require the hands of the one of the individuals to be washed.

11. The method as claimed in claim 1, wherein the area includes multiple hand washing stations wherein hand washing operations at respective hand washing stations are separately determined.

12. The method of claimed 1, wherein the two dimensional array of pyroelectric detectors has at least 200 detector elements and no more than 2,000 detector elements.

13. The method as claimed in claim 1, wherein the two dimensional array of pyroelectric detectors is at least a 16-by-16 array of detector elements and no more than 33-by-33 array of detector elements.

14. A system for monitoring hand washing by individuals by monitoring movements of individuals in an area, identifying a performance of an act by one of the individuals that requires hands of the one of the individuals to be washed before or after the performance of the act, and determining whether the hands of the one of the individuals are washed, the system comprising:

at least one sensor comprising a low resolution two dimensional array of pyroelectric detectors having a sufficient number of elements to track movement of individuals in the area;

a state estimation system communicating with the at least one sensor for outputting information comprising estimates of a state of the individuals monitored by the at least one sensor; and one or more processors configured to process signals from the pyroelectric detectors and said state estimate system performing a group of actions comprising:

tracking a motion of the individuals using a tracking algorithm which retains in memory knowledge of a location of an individual when the individual remains motionless and disappears from an image of the at least one sensor such that the location of the individual is picked up when the individual moves again, providing an indication that the one of the individuals has performed the act that requires the hand washing, and providing an indication that the one of the individuals has performed the hand washing.

15. The system as claimed in claim 14, further comprising additional sensors associated with one or more cleanser dispensers.

16. A non-transitory computer readable medium comprising instructions that when executed by one or more processors in a system comprising at least one sensor having a low resolution two dimensional array of pyroelectric detectors having sufficient elements to track movement of individuals in an area and communicating with a state estimation system for outputting information comprising estimates of the state of individuals monitored by the at least one sensor cause the system to:

monitor movements of individuals in an area using the at least one sensor;

identify a performance of an act by one of the individuals that requires hands of the one of the individuals to be washed before or after the performance of the act; and determining whether the hands of the one of the individuals are washed, wherein the instructions cause the one or more processors in the system to process signals from the pyroelectric detectors and said state estimation system performing a group of actions comprising:

tracking a motion of the individuals using a tracking algorithm which retains in a memory knowledge of a location of an individual when the individual remains motionless and disappears from an image of the at least one sensor such that the location of the individual is picked up when the individual moves again, providing an indication that the one of the individuals has performed that act that requires the hand washing, and providing an indication that the one of the individuals has performed the hand washing.

* * * * *